US009891554B2

(12) United States Patent
Igarashi et al.

(10) Patent No.: US 9,891,554 B2
(45) Date of Patent: Feb. 13, 2018

(54) DEVELOPING DEVICE AND IMAGE FORMING APPARATUS

(71) Applicant: FUJI XEROX CO., LTD., Tokyo (JP)

(72) Inventors: Tatsuhiro Igarashi, Kanagawa (JP); Manabu Furuki, Kanagawa (JP); Masahiro Uchida, Kanagawa (JP); Makoto Kamisaki, Kanagawa (JP); Teppei Yawada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/217,386

(22) Filed: Jul. 22, 2016

(65) Prior Publication Data

US 2017/0176888 A1 Jun. 22, 2017

(30) Foreign Application Priority Data

Dec. 17, 2015 (JP) ..... 2015-246149

(51) Int. Cl.
*G03G 15/08* (2006.01)

(52) U.S. Cl.
CPC ..... *G03G 15/0865* (2013.01); *G03G 15/0893* (2013.01)

(58) Field of Classification Search
CPC ..... G03G 15/0893; G03G 15/0889; G03G 15/0891; G03G 15/0877
USPC ..... 399/254
See application file for complete search history.

(56) References Cited

U.S. PATENT DOCUMENTS

2006/0078354 A1* 4/2006 Kubota ..... G03G 15/0855 399/254
2006/0216067 A1* 9/2006 Okoshi ..... G03G 15/0875 399/258
2007/0242981 A1* 10/2007 Hirota ..... G03G 15/0893 399/254
2008/0285985 A1* 11/2008 Park ..... G03G 15/0822 399/27
2009/0220266 A1* 9/2009 Shiraishi ..... G03G 15/0822 399/58
2011/0129240 A1* 6/2011 Uno ..... G03G 15/0806 399/30
2014/0169805 A1* 6/2014 Valladares Estrada ..... G03G 15/0849 399/27

FOREIGN PATENT DOCUMENTS

JP 2010-145618 A 7/2010

* cited by examiner

*Primary Examiner* — Walter L Lindsay, Jr.
*Assistant Examiner* — Frederick Wenderoth
(74) *Attorney, Agent, or Firm* — Oliff PLC

(57) ABSTRACT

A developing device includes a container chamber that contains developer containing carrier and toner; a supply portion that is adjacent to the container chamber and to which supplying toner or supplying developer, which contains the supplying toner and supplying carrier, is supplied at a supplying position in the supply portion; a transporting member that transports the supplying toner or the supplying developer toward the container chamber in the supply portion; and a guide capable of guiding the developer to the supplying position.

10 Claims, 4 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2015-246149 filed Dec. 17, 2015.

BACKGROUND (i) Technical Field

The present invention relates to a developing device and an image forming apparatus.

(ii) Related Art

In a known electrophotographic image forming apparatus, a latent image is formed on an image carrier, and a developing device develops the latent image with powdered coloring material, such as toner, to form an image.

SUMMARY

According to an aspect of the invention, there is provided a developing device including a container chamber that contains developer containing carrier and toner; a supply portion that is adjacent to the container chamber and to which supplying toner or supplying developer, which contains the supplying toner and supplying carrier, is supplied at a supplying position in the supply portion; a transporting member that transports the supplying toner or the supplying developer toward the container chamber in the supply portion; and a guide capable of guiding the developer to the supplying position.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described with reference to the drawings.

Figure 1:
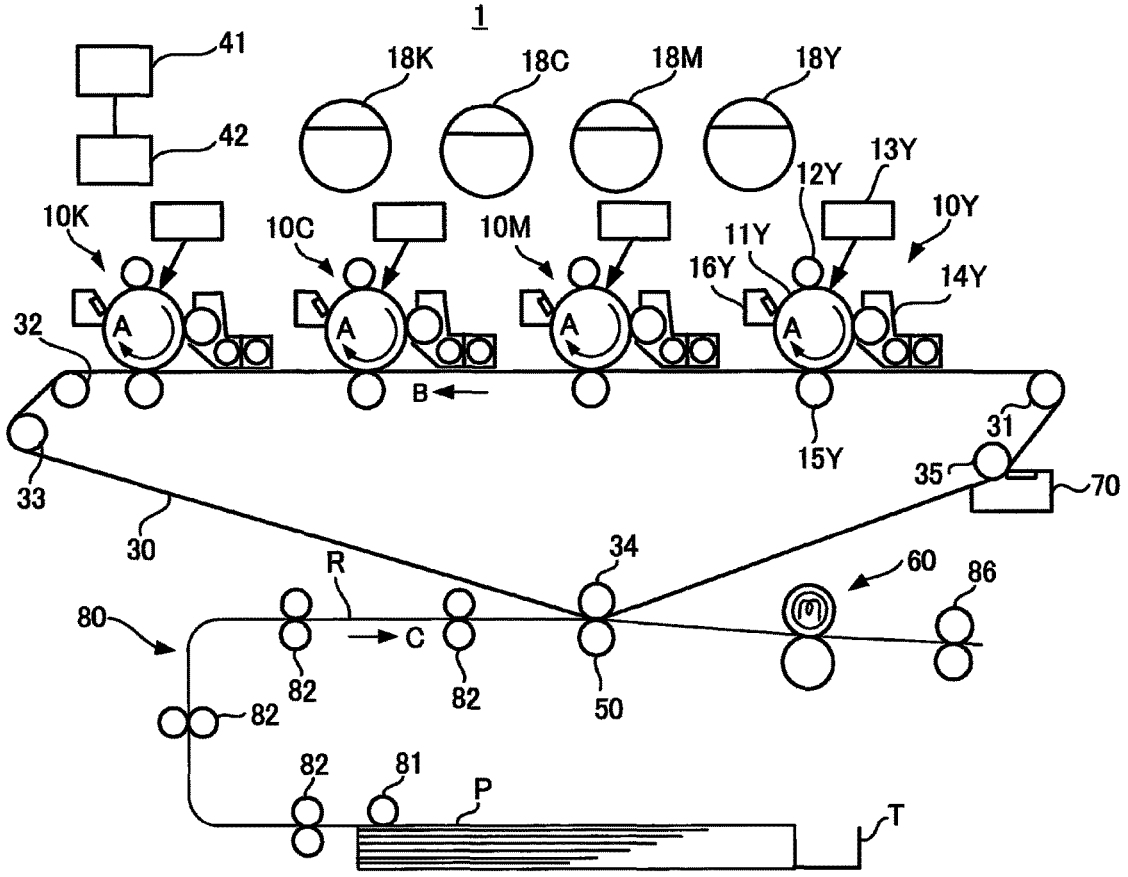
FIG. 1 illustrates the structure of an image forming apparatus according to an exemplary embodiment of the present invention.

FIG. 1 illustrates the structure of an image forming apparatus 1 according to an exemplary embodiment of the present invention.

The image forming apparatus 1 illustrated in FIG. 1 is a tandem-type color printer in which yellow (Y), magenta (M), cyan (C), and black (K) image engines 10Y, 10M, 10C, and 10K, which respectively form toner images of the respective colors in parallel, are arranged in tandem. The color printer is capable of printing monochrome images, and is also capable of printing full-color images by superposing the toner images of the four colors.

The image forming apparatus 1 includes toner cartridges 18Y, 18M, 18C, and 18K containing yellow (Y), magenta (M), cyan (C), and black (K) toners. These toners are examples of a coloring material according to the present invention.

The image forming apparatus 1 also includes an intermediate transfer belt 30, a fixing device 60, a sheet transporting unit 80, a controller 41 that controls each component of the image forming apparatus 1, and an environmental sensor 42 that detects the temperature and humidity in the image forming apparatus 1.

The four image engines 10Y, 10M, 10C, and 10K have the same structure except for the developer used therein; therefore, the yellow image engine 10Y will be explained as a representative example. The image engine 10Y includes a photoconductor 11Y, a charging device 12Y, an exposure device 13Y, a developing device 14Y, a first transfer device 15Y, and a photoconductor cleaner 16Y. Among these components, the components other than the exposure device 13Y and the first transfer device 15Y are assembled into a process cartridge. The process cartridges have the same structure.

The photoconductor 11Y includes a cylindrical body having a photosensitive material layer on the surface thereof, and rotates in the direction of arrow A, which is a direction around the axis of the cylindrical body, while carrying an image formed on the surface thereof. The charging device 12Y, the exposure device 13Y, the developing device 14Y, the first transfer device 15Y, and the photoconductor cleaner 16Y are arranged in that order around the photoconductor 11Y. The photoconductor 11Y is an example of an image carrier according to the present invention. The combination of the charging device 12Y and the exposure device 13Y is an example of a latent-image forming unit according to the present invention. The developing device 14Y is an example of a developing device according to the present invention.

The charging device 12Y charges the surface of the photoconductor 11Y by applying a bias voltage. The charging device 12Y according to the present exemplary embodiment is a charging roller that is in contact with the surface of the photoconductor 11Y. A voltage with the same polarity as the charging polarity of the toner in the developing device 14Y is applied to the charging roller, so that the charging roller charges the surface of the photoconductor 11Y that is in contact therewith. Instead of the charging roller, the charging device 12Y may be, for example, a corona discharge device that is not in contact with the photoconductor 11Y.

The exposure device 13Y performs an exposure process on the surface of the photoconductor 11Y by irradiating the photoconductor 11Y with a laser beam in accordance with an image signal for the corresponding color (yellow in this case). The image signal is generated by the controller 41 on the basis of image data supplied from the outside of the image forming apparatus 1. As a result of the exposure process performed by the exposure device 13Y, an electrostatic latent image is formed on the surface of the photoconductor 11Y. The exposure device 13Y may be an LED array, in which plural LEDs are arranged in a scanning direction, instead of the system using the laser beam.

The developing device 14Y forms a toner image by developing the electrostatic latent image on the surface of the photoconductor 11Y by using a two-component developer containing toner and magnetic carrier. The developing device 14Y receives the toner from the toner cartridge 18Y. As described in detail below, the developing device 14Y is a trickle-type developing device in which part of the developer contained in the developing device 14Y is ejected little by little to refresh the magnetic carrier. A small amount of magnetic carrier is also supplied from the toner cartridge 18Y together with the toner. The developing device 14Y stirs the developer therein to charge the toner. An external additive may be added to the toner to improve the fluidity and chargeability of the toner.

The first transfer device 15Y faces the photoconductor 11Y with the intermediate transfer belt 30 interposed therebetween. A voltage with a polarity opposite to the charging polarity of the toner is applied to the first transfer device 15Y, so that the toner image on the photoconductor 11Y is electrostatically attracted to the intermediate transfer belt 30.

The photoconductor cleaner 16Y cleans the surface of the photoconductor 11Y after the transfer process by scraping off the residual toner, external additive, paper dust, etc., from the surface of the photoconductor 11Y with a cleaning blade that is in contact with the surface of the photoconductor 11Y.

The intermediate transfer belt 30 is an endless belt provided around the belt support rollers 31 to 35, and is rotated in the direction of arrow B via the image engines 10Y, 10M, 10C, and 10K and a second transfer device 50. The toner images of the respective colors formed by the image engines 10Y, 10M, 10C, and 10K are transferred onto the intermediate transfer belt 30 in a superposed manner, so that a color toner image is formed. The intermediate transfer belt 30 rotates in the direction of arrow B while carrying the toner image, and transports the toner image to the second transfer device 50.

In the sheet transporting unit 80, a sheet P contained in a sheet container T is picked up by a pick-up roller 81 and transported in the direction of arrow C to the second transfer device 50 along a sheet transport path R by transport rollers 82.

The second transfer device 50 is a roller that rotates while the intermediate transfer belt 30 and the sheet are sandwiched between the roller and a backup roller 34, which is one of the belt support rollers 31 to 35. A voltage with a polarity opposite to the charging polarity of the toner is applied to the second transfer device 50, so that the toner image on the intermediate transfer belt 30 is electrostatically attracted to the sheet and an unfixed toner image is formed on the sheet.

A belt cleaner 70 brings a blade into contact with the intermediate transfer belt 30 that has passed through the second transfer device 50, thereby scraping off the toner, external additive, paper dust, etc., from the intermediate transfer belt 30.

The fixing device 60 fixes the unfixed toner image to the sheet by applying heat and pressure.

The sheet with the toner image fixed thereto is ejected to the outside of the apparatus by an output roller 86, which is a component of the sheet transporting unit 80.

The developing device will be further described. In the following description, the characters representing the colors, that is, 'Y', 'M', 'C', and 'K', attached to the reference numerals are omitted.

Figure 2:
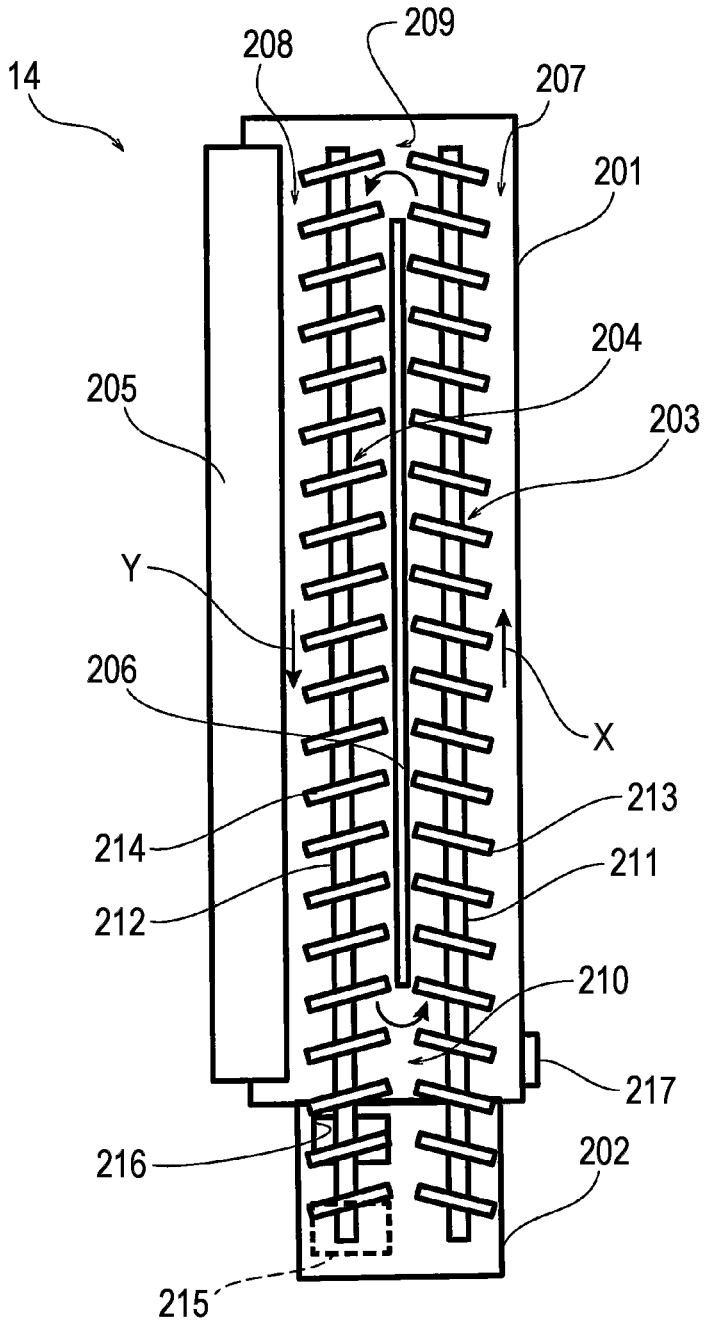
FIG. 2 is a top view illustrating the interior of a developing device illustrated in FIG. 1.

FIG. 2 is a top view illustrating the interior of a developing device illustrated in FIG. 1.

The developing device 14 includes a developer containing chamber 201 that contains the developer therein, a toner supplying portion 202 disposed adjacent to the developer containing chamber 201, two transporting members 203 and 204 that extend parallel to each other, and a developing roller 205 that extends parallel to the transporting members 203 and 204 and rotates in a direction perpendicular to the transporting members 203 and 204. The developer containing chamber 201 is an example of a container chamber according to the present invention, and the toner supplying portion 202 is an example of a supply portion according to the present invention.

The developing roller 205 includes a magnet disposed therein, and rotates while attracting the developer to the surface thereof with a magnetic force, thereby carrying the developer from the developer containing chamber 201 to a developing position at which the developing roller 205 faces the photoconductor 11. The latent image is developed at the developing position. After the developing process, the developer is returned to the developer containing chamber 201 by the rotation of the developing roller 205.

A separation wall 206 is disposed between the two transporting members 203 and 204 in the developer containing chamber 201, so that the developer containing chamber 201 is divided into two sections 207 and 208. The separation wall 206 has openings 209 and 210 at both ends thereof in the longitudinal direction.

The two transporting members 203 and 204 include circular rod-shaped rotating shafts 211 and 212, and helical blades 213 and 214 that extend helically around the rotating shafts 211 and 212 in the direction in which the rotating shafts 211 and 212 extend. The transporting members 203 and 204 are rotated such that the first transporting member 203 transports the developer in the first section 207 in the direction of arrow X while stirring the developer, and such that the second transporting member 204 transports the developer in the second section 208 in the direction of arrow Y while stirring the developer. The developer transported in the direction of arrow X passes through the first opening 209 and enters the second section 208, and the developer transported in the direction of arrow Y passes through the second opening 210 and enters the first section 207. Thus, the developer in the developer containing chamber 201 is circulated while being stirred by the two transporting members 203 and 204. As described above, the toner contained in the developer is charged when the developer is stirred.

The transporting members 203 and 204 extend into the toner supplying portion 202 that is adjacent to the developer containing chamber 201. However, normally, the developer circulates without passing through the toner supplying portion 202.

An inlet 215 for the toner supplied from the toner cartridge 18 is formed in the top surface of the toner supplying portion 202 at a location separated from the developer containing chamber 201. The toner injected into the developing device 14 through the inlet 215 is transported by the transporting members 203 and 204 to the first section 207 of the developer containing chamber 201, and is mixed with the developer. Portions of the transporting members 203 and 204 that extend into the toner supplying portion 202 are an example of a transporting member according to the present invention. The transporting member according to the present invention may be a component other than the stirring member that stirs the developer in the developer containing chamber 201. However, as in the present exemplary embodiment, the transporting members 203 and 204 may be used to simplify the structure.

An outlet 216 is formed at the bottom of the toner supplying portion 202 at a location between the inlet 215 and the developer containing chamber 201. A partition is provided between the developer containing chamber 201 and the toner supplying portion 202. Therefore, most of the developer transported in the direction of arrow Y through the second section 208 of the developer containing chamber 201 is guided to the second opening 210 by the partition between the developer containing chamber 201 and the toner supplying portion 202 and enters the first section 207. However, some of the developer overflows and moves over the partition to enter the toner supplying portion 202. The developer that has entered the toner supplying portion 202 is discharged from the developing device 14 through the outlet 216. The outlet 216 may be opened and closed by a shutter under the instructions of the controller 41 illustrated in FIG. 1.

The developing device 14 includes a TC sensor 217 that measures a toner-to-carrier (TC) ratio in the developer that circulates in the developer containing chamber 201. Based on the measurement value obtained by the TC sensor 217, the controller 41 issues an instruction for supplying the toner from the toner cartridge 18 so that the TC ratio of the developer is maintained constant.

Since the toner density in the toner supplying portion 202 is high, when the temperature or humidity is high or when formation of high-density images is continuously performed, there is a risk that the toner will adhere to the transporting members 203 and 204.

Figure 3:
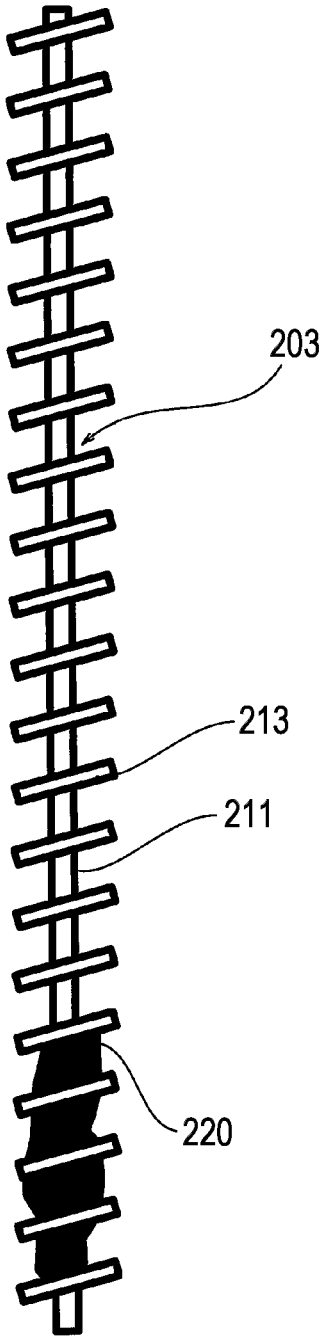
FIG. 3 illustrates the state in which toner has adhered to a rotating shaft of a transporting member.

FIG. 3 illustrates the state in which the toner has adhered to the rotating shaft 211 of the transporting member 203.

When the temperature or humidity is high or when formation of high-density images is continuously performed, there is a risk that toner 220 will adhere to the rotating shaft 211 of the transporting member 203 and remain at the rotating shaft 211. The adhesion of the toner 220 leads to a reduction in the transporting force of the transporting member 203. As a result, the following toner may be blocked in the transport path and clogging of the path may occur.

Although FIG. 3 illustrates the first transporting member 203 among the two transporting members, the second transporting member 204 also has a similar risk.

To suppress the adhesion of the toner 220, the developing device 14 according to the present exemplary embodiment closes the outlet 216 when a change in conditions that may increase the adhesion of the toner 220 has occurred. In the present exemplary embodiment, such a change in conditions includes a change in temperature or humidity beyond a certain criterion and an increase in the density of the image to be formed beyond a certain criterion. The changes in temperature and humidity are detected by the environmental sensor 42 illustrated in FIG. 1, and the change in the image density is detected by the controller 41 illustrated in FIG. 1.

When the outlet 216 is closed, the toner 220 is easily removed from the rotating shaft 211, as described below.

Figure 4:
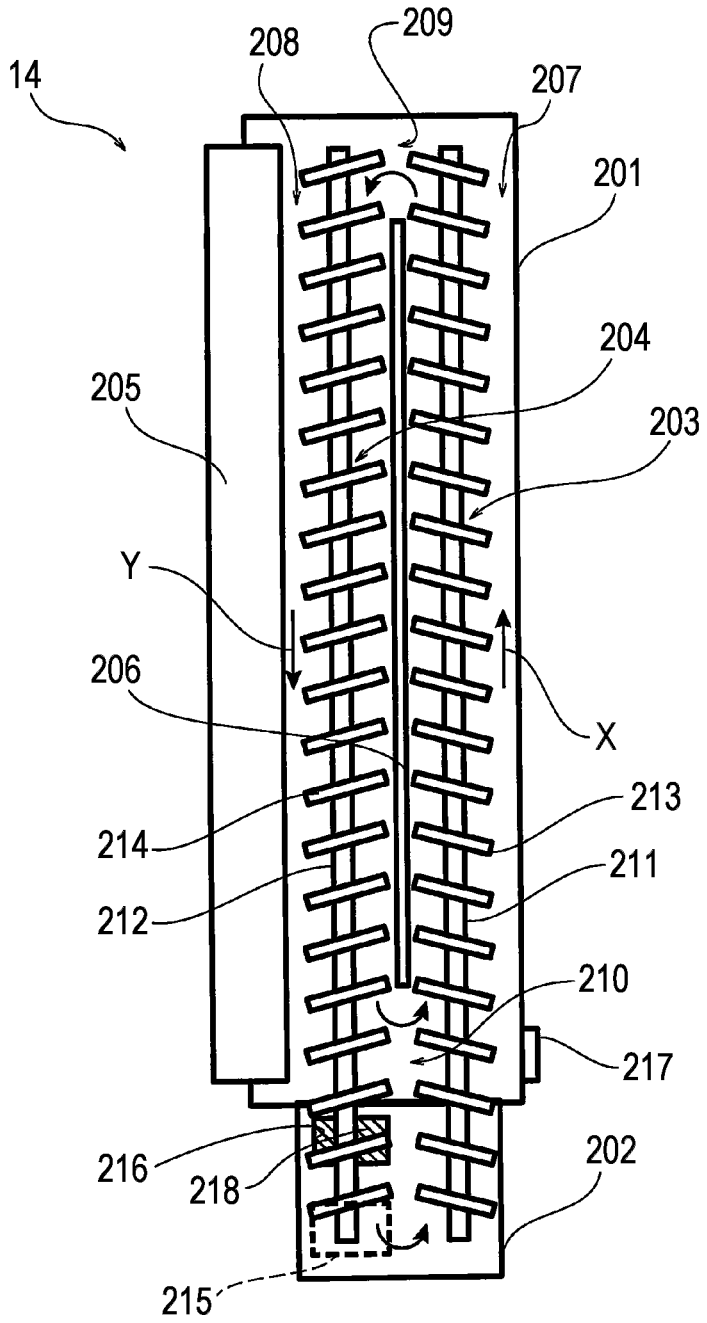
FIG. 4 illustrates a mechanism for removing the toner from the rotating shaft.

FIG. 4 illustrates a mechanism for removing the toner 220 from the rotating shaft 211.

When the outlet 216 is closed by a shutter 218 as shown by the shaded area in FIG. 4, the developer that has overflowed the developer containing chamber 201 and entered the toner supplying portion 202 is transported by the transporting members 203 and 204 in the toner supplying portion 202 and guided to a region below the inlet 215. The shutter 218 is an example of a guide according to the present invention. The guided developer is further transported by the transporting members 203 and 204 in the toner supplying portion 202 toward the developer containing chamber 201. When the developer is being transported, the developer comes into contact with the aggregate of toner 220 that has adhered to the rotating shafts 211 and 212. Since the developer contains the magnetic carrier, the aggregate of toner 220 is disintegrated when the developer comes into contact therewith, and the toner 220 is easily removed from the rotating shaft 211. As a result, the adhesion of the toner to the transporting members 203 and 204 is suppressed, and the transporting force of the transporting members 203 and 204 is maintained.

In the present exemplary embodiment, the shutter that guides the developer that has overflowed the developer containing chamber 201 to the region below the inlet 215 is described as an example of the guide according to the present invention. However, the guide according to the present invention may instead be configured to forcibly guide the developer out of the developer containing chamber 201.

Furthermore, although a tandem-type image forming apparatus including plural image carriers is described above as an example of an image forming apparatus, the image forming apparatus according to the present invention may instead be a revolver-type image forming apparatus in which toner images of respective colors are formed on a single image carrier.

Furthermore, although a printer is described above as an example of an image forming apparatus, the image forming apparatus according to the present invention may instead be a facsimile machine, a copy machine, or a multifunction machine.

Furthermore, although an indirect-transferring image forming apparatus including an intermediate transfer belt is described above as an example of an image forming apparatus, the image forming apparatus according to the present invention may instead be a direct transferring image forming apparatus in which the toner images are directly transferred onto a sheet of paper from an imager carrier.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a container chamber that contains developer containing carrier and toner;

a supply portion that is adjacent to the container chamber and to which supplying toner or supplying developer, which contains the supplying toner and supplying carrier, is supplied at a supplying position in the supply portion;

a transporting member that transports the supplying toner or the supplying developer toward the container chamber in the supply portion; and a guide capable of guiding the developer to the supplying position, wherein the guide is a structure separate from the transporting member and is disposed within the supply portion, and wherein the guide is a shutter.

2. The developing device according to claim 1, wherein an outlet capable of being opened and closed is disposed upstream of the supplying position in the supply portion in a direction in which the supplying toner is transported, the developer that has overflowed the container chamber being discharged from the supply portion through the outlet, and wherein the guide closes the outlet to guide the developer to the supplying position.

3. The developing device according to claim 1, wherein the guide guides the developer to the supplying position on the basis of a condition that causes at least one of a temperature increase or a humidity increase.

4. The developing device according to claim 1, wherein the guide guides the developer to the supplying position on the basis of a condition that causes an increase in image density.

5. The developing device according to claim 1, wherein the supplying carrier of the supplying developer is the same as the carrier of the developer.

6. The developing device according to claim 1, wherein an amount of the supplying carrier in the supplying developer is less than an amount of the carrier in the developer.

7. An image forming apparatus comprising:

an image carrier that carries an image formed on a surface of the image carrier:

a latent-image forming unit that forms a latent image on the surface of the image carrier;

a developing device that develops the latent image with developer containing carrier and toner, wherein the developing device includes a container chamber that contains the developer containing the carrier and the toner, a supply portion that is adjacent to the container chamber and to which supplying toner or supplying developer, which contains the supplying toner and supplying carrier, is supplied at a supplying position in the supply portion, a transporting member that transports the supplying toner or the supplying developer toward the container chamber in the supply portion, and a guide capable of guiding the developer to the supplying position, wherein the guide is a structure separate from the transporting member and is disposed within the supply portion, and wherein the guide is a shutter.

8. The image forming apparatus according to claim 7, wherein an outlet capable of being opened and closed is disposed upstream of the supplying position in the supply portion in a direction in which the supplying toner is transported, the developer that has overflowed the container chamber being discharged from the supply portion through the outlet, and wherein the guide closes the outlet to guide the developer to the supplying position.

9. The image forming apparatus according to claim 7, wherein the guide guides the developer to the supplying position on the basis of a condition that causes at least one of a temperature increase or a humidity increase.

10. The image forming apparatus according to claim 7, wherein the guide guides the developer to the supplying position on the basis of a condition that causes an increase in image density.

* * * * *